US006279820B1

(12) United States Patent
Collinet

(10) Patent No.: US 6,279,820 B1
(45) Date of Patent: Aug. 28, 2001

(54) CARDBOARD PACK FOR DISPLAY STAND

(75) Inventor: Michel J. Collinet, Remigny (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/535,122

(22) Filed: Mar. 24, 2000

(30) Foreign Application Priority Data

May 3, 1999 (FR) ..... 99 05736

(51) Int. Cl.[7] ..... B65D 5/468
(52) U.S. Cl. ..... 229/117.14; 206/806; 229/117.18
(58) Field of Search ..... 206/461, 464, 206/467, 470, 471, 806; 229/117.13, 117.14, 117.18

(56) References Cited

U.S. PATENT DOCUMENTS 3,480,138 11/1969 Baker .
3,814,303 * 6/1974 Smith ..... 206/806
3,985,232 10/1976 Johnson .
4,106,615 8/1978 Hiroshi .
4,378,903 * 4/1983 Sherwood ..... 206/806
5,341,923 * 8/1994 Arasim ..... 206/806
5,692,671 * 12/1997 Mussier et al. ..... 206/806

FOREIGN PATENT DOCUMENTS 92 01 283 3/1992 (DE) .
42 22 488 10/1993 (DE) .
43 22 555 1/1995 (DE) .
2 743 542 7/1997 (FR) .

* cited by examiner

*Primary Examiner*—Luan K. Bui
(74) *Attorney, Agent, or Firm*—Susan L. Parulski

(57) ABSTRACT

The blank produces a cardboard pack having a display card provided with a hooking aperture and a case provided with a body whose general shape is a rectangular parallelogram provided with two openings closed by flaps. According to the invention, the display card is provided with a fixing flap extending beyond the periphery of the card and intended to be fixed with at least one of the flaps intended to close the opening in order to increase the linking between the case and the hooking tab when the case formed on the hooking tab is closed.

8 Claims, 4 Drawing Sheets

CARDBOARD PACK FOR DISPLAY STAND

CROSS-REFERENCE TO RELATED APPLICATIONS

The present application claims priority of French Patent Application No. 9905736, filed May 3, 1999, titled "Cardboard Pack For Display Stand," by Michael J. Collinet.

FIELD OF THE INVENTION

The present invention relates to the packaging field and in particular to cardboard packs intended to be hooked to display stands. More specifically, the pack can be in cardboard or in another easily biodegradable or recyclable material, and have a display card having a hooking aperture, and in which the fixing of the case to the display card is improved; the manufacturing operations, the introduction of objects to be packaged in the case and the closing of the case being able to be done by simple mechanisms.

BACKGROUND OF THE INVENTION

The documents DE-A-43 22 555 and U.S. Pat. No. 4,106,615 describe cases produced from a single cardboard blank. The cases have tabs intended for hooking them to display stands. When the objects to be distributed are relatively small, for example photographic roll films, the packs are small and can easily fit in a pocket. To prevent the disappearance of articles inside a store, it has been proposed, as described in the document U.S. Pat. No. 3,480,138, to stick small cases onto cardboard cards of a larger size. Then, it has been proposed to use a single blank for the case and for the display card. The Patent DE-A-42 22 488 proposes a pack wherein the display card is larger than the case and has an opening equal to that of the formed case. In addition, the part making the case is linked to the part making the card by a spacer, thus enabling the case to be put inside the opening provided in the display card. This embodiment is difficult to produce automatically as the case is introduced in an opening after the formation of the case and its filling. Thus, in French Patent 2 743 542 a pack has been proposed that can be produced from a single cardboard blank wherein the case is stuck on the display card, which does not have such disadvantages.

Nevertheless, it has been noted that the use of this type of cardboard pack on display cards has a disadvantage. Pulling relatively gently on the case causes the case and the card to become unstuck and gives relatively easy access to the product contained in the case.

For ecology needs, it is advantageous to be able to produce such a pack from cardboard wherein the fixing of the case to the display card is improved. It is clear that the operations of case forming, case filling and case closing must be easy to do using conventional machines.

SUMMARY OF THE INVENTION

The pack for the display stand according to the invention is obtained by means of a single blank having a first part intended to form the case, a second part intended to form a display card whose area is greater than the straight forward projection of the case on this card, and possibly a third part intended to distance the case from the edges of the hooking tab. The case, once formed, comprises a body defining at least one opening and closing flaps intended to close this opening. The display card comprises at least one fixing flap extending beyond the periphery of the display card and intended to be fixed to at least one of the closing flaps so as to increase the link between the case and the display card when the case formed on the hooking tab is closed.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

To facilitate understanding, identical reference numerals have been used, where possible, to designate identical elements that are common to the figures.

DETAILED DESCRIPTION OF THE INVENTION

Figure 1:
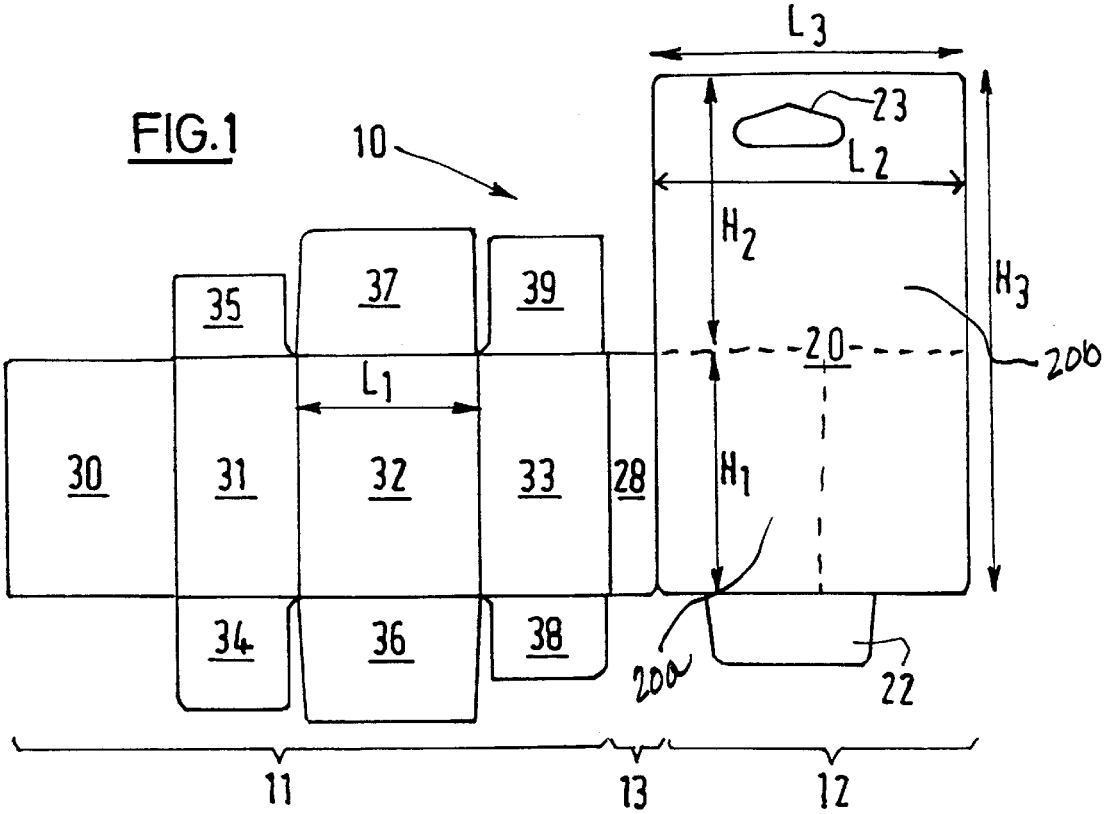
FIG. 1 represents a first embodiment according to the invention.

The following is a detailed description of the preferred embodiments of the invention, reference being made to the drawings in which the same reference numerals identify similar elements of structure in each of the several figures.

Figure 7:
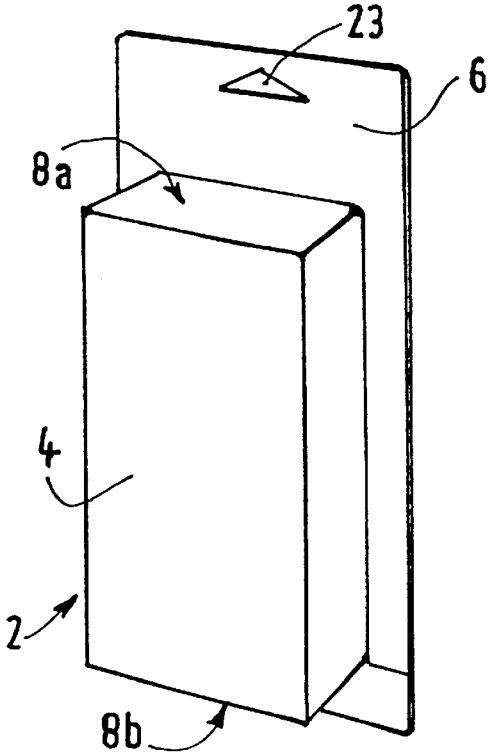
FIG. 7 represents a perspective view of the pack obtained from a blank according to the invention.

As can be seen in FIG. 7, the invention proposes the provision of a pack 2 comprising a case 4 fitted with a display card 6 and whose openings 8*a*, 8*b* are closed by flaps.

As can be seen in FIGS. 1–5, the case 4 is formed from a single blank 10, preferably cardboard. Clearly any other material can be used, however easy-to-recycle materials will be preferred. The blank 10 comprises a series of elements, panels and flaps all hinged one to another. The blank 10 comprises a first part 11 intended to form the cise 4, a second part 12 intended to form the display card 6, and possibly a third part 13 enabling the position of the case 4 to be distanced from the edges of the display card 6.

There now follows a description of the first part 11 of the blank 10 enabling the case 4 to be produced. The case 4 comprises a body defined by four practically rectangular elements 30, 31, 32, 33. The first rectangular element 30, used for the rear, is intended to fix the case 4 onto the second part 12 of the blank 10 which forms the display card 6. The second rectangular element 31, hinged to one 41 of the edges (FIG. 2) of the first rectangular element 30, defines one side of the case 4. The third rectangular element 32, hinged to the second rectangular element 31 by the edge 42 (FIG. 2) opposite that used for hinging between the first rectangular element 30 and the second rectangular element 31, defines the front of the case 4. The fourth rectangular element 33, hinged to the third rectangular element 32 by the edge 43 (FIG. 2) opposite that used for hinging between the third rectangular element 32 and the second rectangular element 31, defines the other side of the case 4. When the case 4 is formed, the edge 40 (FIG. 2), of the edges of the first rectangular element 30 opposite the edge 41 used for hinging between the first and second rectangular element 30, 31, is brought very near to the edge 44 of the fourth rectangular element 33 opposite the edge 43 used for hinging between the third and the fourth rectangular elements 32, 33, in such a way as to form a tube of practically rectangular cross-section defining two openings 8*a* and 8*b* (FIG. 7).

The opposing edges 45 and 46 (FIG. 2) of the second rectangular element 31 defining part of the openings 8*a* and 8*b*, are each provided with a closing flap 34 and 35 respectively. The opposing edges 47 and 48 (FIG. 2) of the third rectangular element 32 defining part of the openings 8*a* and 8*b*, are each provided with a closing flap 36 and 37 respectively. The opposing edges 49 and 50 (FIG. 2) of the fourth rectangular element 33 defining part of the openings 8*a* and 8*b*, are each provided with a closing flap 38 and 39 respectively. The closing flaps 34 to 39 enable the openings 8*a* and 8*b* to be closed (FIG. 7).

There now follows a description of the second part 12 of blank 10 intended to form the display card 6.

In a first embodiment, shown in FIG. 1, the second part 12 of blank 10 comprises a first panel 20 having a first zone 20*a* intended to receive the rear of the case 4. This first zone 20*a* has a height at least equal to the height $H_1$ of the case 4 and a width at least equal to the width $L_1$ of the case. The first panel 20 30 also has a second zone 20*b*, adjacent to the first zone 20*a*, of height $H_2$ and width $L_2$ usually equal to the width of the first zone, the full width of panel 20 being enoted by $L_3$ and full height by $H_3$. This second zone 20*b* is provided with a hooking aperture 23 whose shape is usually that of an isosceles triangle and whose point is directed towards the adjacent side which is arranged opposite the first one 20*a*. This aperture 23 is used for hooking the pack onto the display stand.

The second part 12 of blank 10 is provided, according to the invention, with a fixing flap 22 hinged to the first panel 20. The fixing flap 22 is arranged in such a way as to be fixed to at least one of the closing flaps 34–39 of the case 4 when the case 4, once filled, is closed. In this way, when the case 4 is closed, the fixing of the four flaps 34, 36, 38 and 22 increases the fixing of the case 4 on the display card 6.

In this first embodiment, the first part 11 of the blank 10 making the case 4 is linked to the second part 12 of the blank 10 making the display card 6 by a distancing spacer 28 enabling the case 4 to be distanced from the edge of the display card 6. It will be noticed that the position of the hinged fixing flap 22 on the display card 6 is a function of the dimension separating the first part 11 of the blank 10 making the case 4 from the second part 12 of the blank 10 making the display card 6.

This first embodiment wherein the display card 6 only comprises a single panel has a disadvantage because for the whole pack the visible sides of the case are obtained with the back of the blank 10 while the visible face of the display card 6 is obtained with the front of the blank 10. If a uniform presentation is desired then both faces of the blank 10 must be printed.

Figure 2:
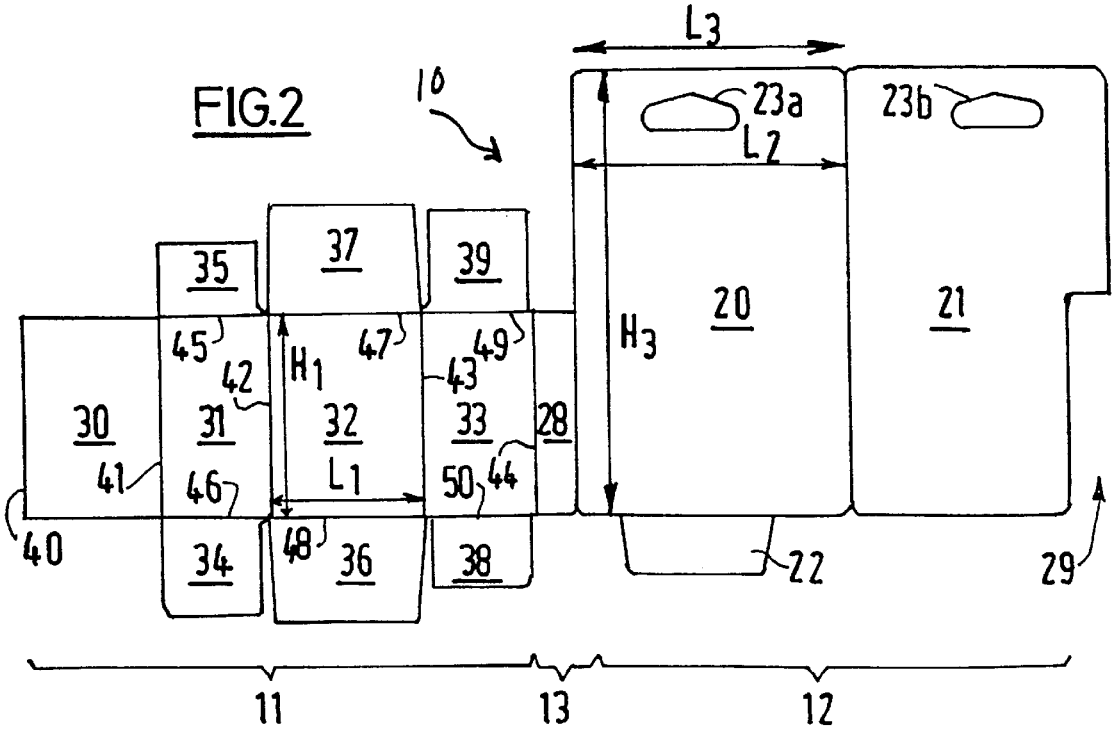
FIG. 2 represents a second embodiment according to the invention.

To prevent such an operation a pack 2 can be produced according to the invention with an improved blank 10 for example that is represented in FIG. 2. This second embodiment only differs from the previous one by the different production of the display card 6. In addition to the first panel 20, the display card 6 is provided with a second panel 21 of second part of blank 10, practically identical to the first panel 20 and hinged to the first panel 20 by the edge opposite to that on which the third part 13 of blank 10 is hinged. As can be seen in FIG. 2, the second panel 21 has a hooking aperture 23*b* corresponding in position, in shape and size to the hooking aperture 23*a* of the first panel 20. When pack 2 is being formed, second panel 21 is folded and fixed to first panel 20. In this way, both faces of the display card 6 have the same appearance which will then be identical to the appearance of the case 4 once the case 4 had been formed. In addition the interaction of the apertures 23*a* and 23*b* defines the hooking aperture 23. As can be seen in FIG. 2, the second panel 21 is provided with a cutout 29 in order to prevent over thickening of the display card 6 at the distancing spacer 28 position when the pack 2 is formed. It is clear that it would also be possible to choose to hinge the second panel 21 onto the edge of the first panel 20 adjacent to the hooking aperture 23.

Figure 3:
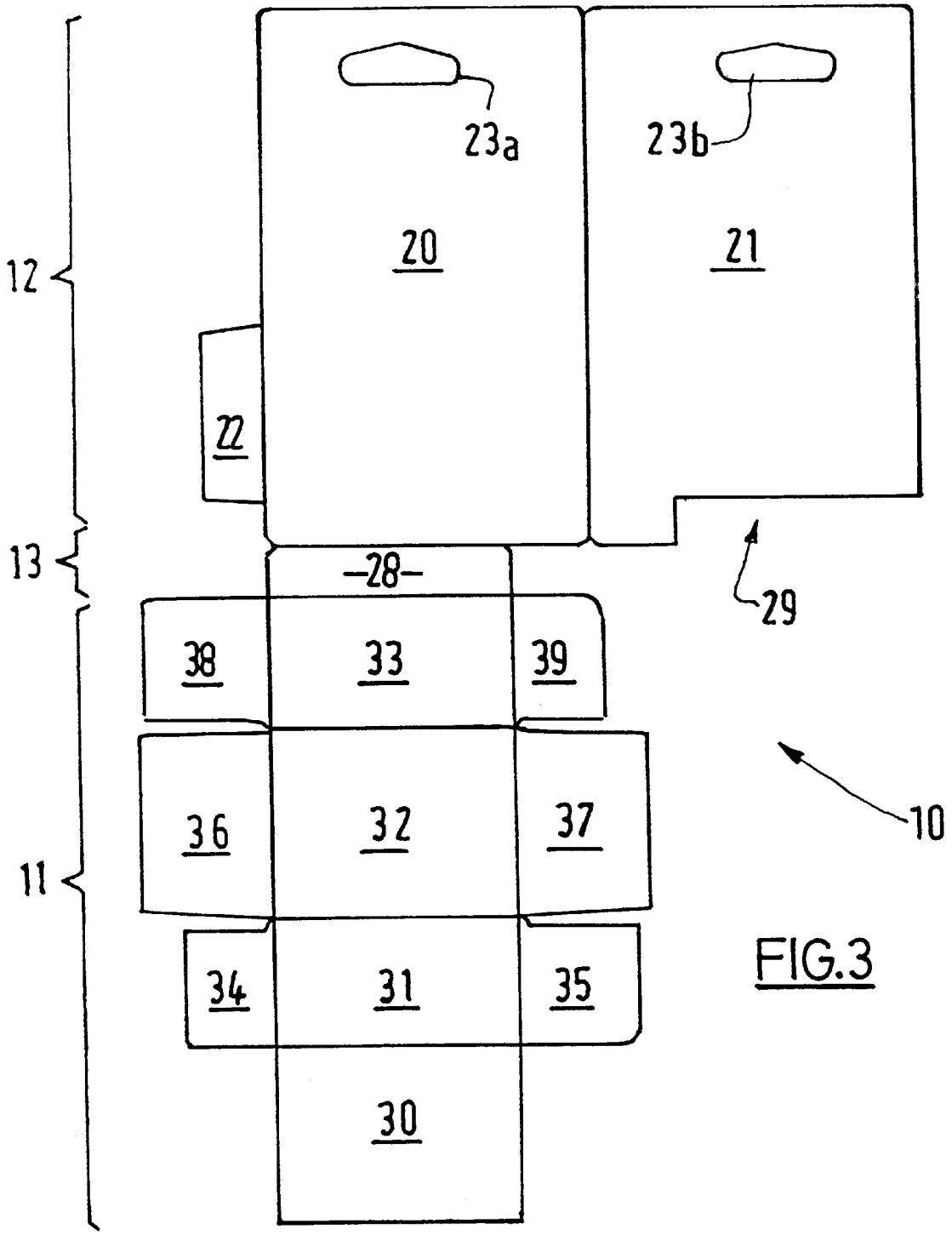
FIG. 3 represents a third embodiment according to the invention.

The third embodiment, represented in FIG. 3 demonstrates that the orientation of the case 4 can easily be controlled by the location of the first part 11 of the blank 10 making the case 4 in relation to the second part 12 of the blank 10 making the display card 6.

Figure 4:
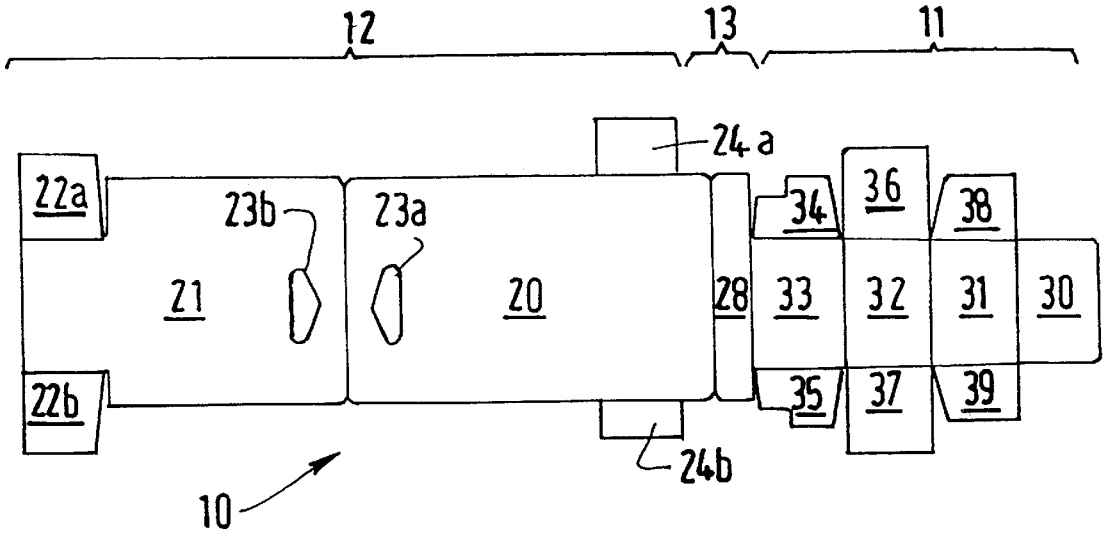
FIG. 4 represents a fourth embodiment according to the invention wherein the case is arranged inside the hooking tab.

In a fourth embodiment, represented in FIG. 4, the first part 11 of the blank 10 is similar to that used in the embodiments described above. The second part 12 of the blank 10 is obtained as in the second embodiment essentially from two practically identical panels 20, 21 each having a hooking aperture 23*a* and 23*b* respectively. The two panels are hinged by one edge and can be folded one against the other so as to form the display card 6 and give it the same appearance as that of the case 4. As can be seen in FIG. 4, the first part 11 of blank 10 making the case 4 is linked to the second part 12 of blank 10 making the display card 6 by a third part 13 of blank 10 used as distancing spacer 28. In the embodiment represented, the length of the distancing spacer 28 is greater than the corresponding dimension of the case 4 and is equal to the dimension of the display card 6. The second panel 21, on which second rectangular element 31 of the case 4, making the rear of this case, will be fixed, is provided with two fixing flaps 22*a* and 22*b* extending beyond the periphery of the display card 6 and intended to be fixed to at least one closing flap of the opening of the case 4. In a similar way and with the aim of obtaining an improved appearance of the display card 6, the first panel 20, to which the second panel 21 having flaps 22*a*, 22*b* is fixed, is provided with two presentation flaps 24*a* and 24*b* intended to be folded and fixed to the second panel 21 with the aim of providing the same appearance to the part uncovered by the flaps 22*a* and 22*b* when the flaps 22*a* and 22*b* are fixed to the closing flaps 34 to 39 intended for closing the case 4. It will be seen that in this embodiment the fixing flaps 22*a* and 22*b* used to improve the fixing of the case 4 to the display card 6 are part of the panel used for the front of the display card 6, and not, as in the embodiments represented in FIGS. 1–3, part of the panel used for the rear.

Figure 5:
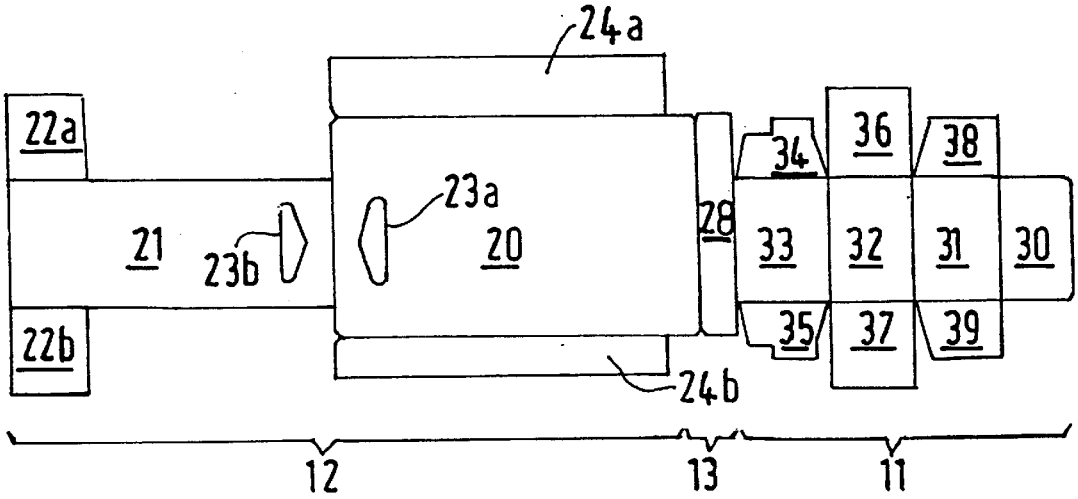
FIG. 5 represents a fifth embodiment according to the invention similar to that shown in FIG. 4.

As can be seen in the embodiment represented in FIG. 5, the display card 6 can be obtained by the interaction of one main rear panel 20 having a hooking aperture 23*a* and several other panels. One main front panel 21 with fixing flaps 22*a* an 22*b* and a hooking aperture 23*b* interact with the hooking aperture 23*a*. Two presentation flaps 24*a* and 24*b* interact with the distancing spacer 28 to improve the presentation of the front of the display card 6.

Figure 6:
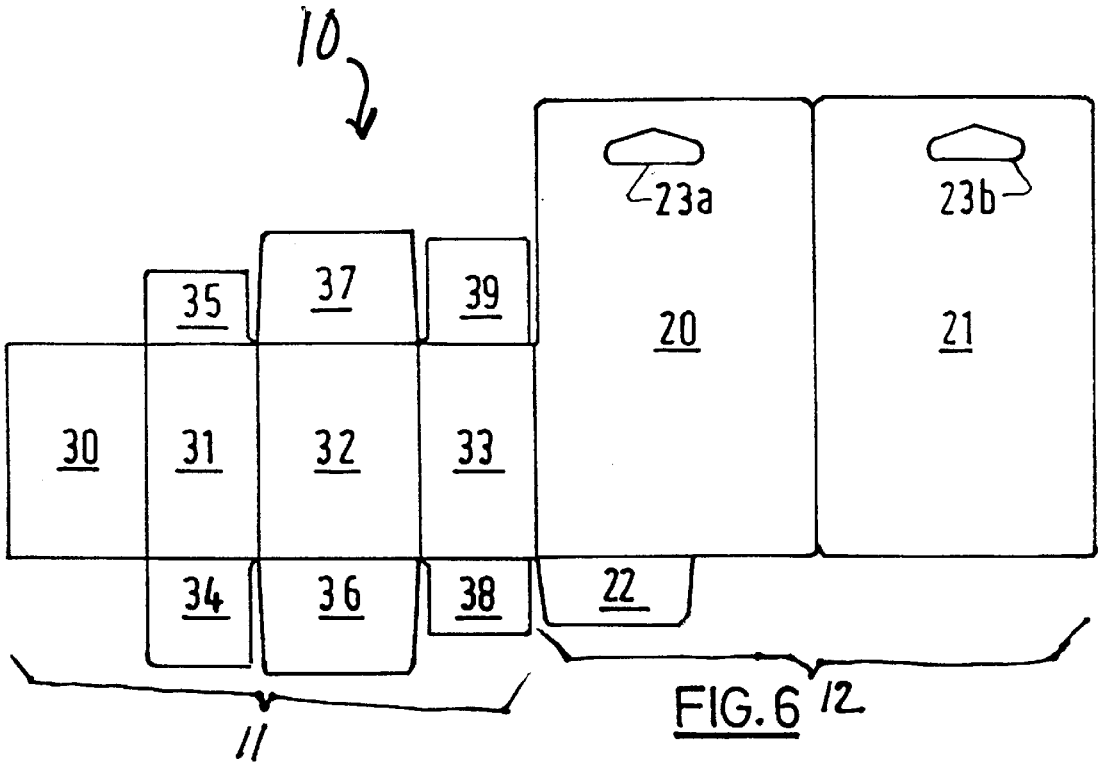
FIG. 6 represents a sixth embodiment according to the invention similar to that shown in FIG. 1 wherein the part of the blank used to form the case is hinged directly to the part of the blank used to form the display card.

The embodiment represented in FIG. 6 is similar to that of FIG. 2. However, this embodiment demonstrates that when the case 4 is arranged in one corner of the display card 6, the third part 13 of the blank 10 is not necessary.

In order to produce the pack 2 delivered flat, for example that of the embodiment represented in FIG. 2, the second panel 21 is glued and folded according to the score line between the first and second panels 20, 21. Then, the blank 10 is folded according to the score line 42 between the third rectangular element 32 and the second rectangular element 31, then the first zone of the second panel 21 is glued and the blank 10 is folded according to the score line between the first panel 20 and either the third part 13 of blank 10 or the side, forth rectangular element 33 when there is no third part 13 of blank 10.

To package an object, the packaging machine in the usual way folds the preformed pack 2 that is supplied to it flat, closes one 8*b* of the two openings (that of the two openings having four flaps) by putting the fixing flap 22 between the side flaps 34, 38 and the closing flap 36 hinged on the front. Then, the four flaps are fixed to one another, the product to be marketed is introduced in the case thus formed, and the other opening 8*a* having three flaps 35, 37, 39 is closed in the embodiments represented in FIGS. 1, 2, 3 and 6, or the four flaps in the embodiments represented in FIGS. 4 and 5.

Figure 8:
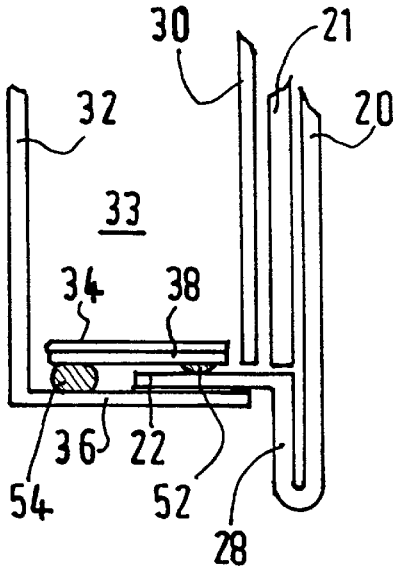
FIG. 8 represents the cross-section of the pack according to the invention represented in FIG. 7 at the level of the opening 8*b*.

As can be seen in FIG. 8, the fixing flap 22 is fixed to the flap 36 hinged on the front of the case 4 by one glue line 52. In one advantageous embodiment, the case flaps can have an appropriate cutout that can have a shape near to that represented in FIG. 4 or 5. In this way the interaction between the flaps 34 and 38 and between the flaps 35 and 39 allows the side flaps to appear side by side, which can be glued to the flap 36 corresponding to the front using a single glue line 54 applied to the flap 36. Clearly to be able to perform this operation the fixing flap 22 will have, for example, the shape represented in FIG. 3 and should only cover a small part of the opening as can be seen in FIG. 8.

Several embodiments have been described for a pack 2 with a hooking tab. Clearly the case 4 can be centered in relation to the rear, first panel 20 of the display card 6, as has been described with reference to FIGS. 1–6. However, the width of the distancing spacer 28 enables the case 4 to be located in the place required on the first zone of first panel 20.

The invention has been described with reference to a preferred embodiment; However, it will be appreciated that variations and modifications can be effected by a person oi ordinary skill in the art without departing from the scope of the invention.

PARTS LIST

| | |
|---|---|
| 2 | pack |
| 4 | case |
| 6 | display card |
| 8a | opening |
| 8b | opening |
| 10 | blank |
| 11 | first part of blank 10 |
| 12 | second part of blank 10 |
| 13 | third part of blank 10 |
| 20 | first panel of second part 12 of blank 10 |
| 20a | first zone of panel 20 |
| 20b | second zone of panel 20 |
| 21 | second panel of second part 12 of blank 10 |
| 22 | fixing flap |

-continued

| | |
|---|---|
| 22a | fixing flap |
| 22b | fixing flap |
| 23 | hooking aperture |
| 23a | hooking aperture |
| 23b | hooking aperture |
| 24 | presentation flap |
| 24a | presentation flap |
| 24b | presentation flap |
| 28 | distancing spacer |
| 29 | cutout |
| 30 | first rectangular element |
| 31 | second rectangular element |
| 32 | third rectangular element |
| 33 | fourth rectangular element |
| 34 | closing flap |
| 35 | closing flap |
| 36 | closing flap |
| 37 | closing flap |
| 38 | closing flap |
| 39 | closing flap |
| 40 | edge |
| 41 | edge of first rectangular element 30 |
| 42 | edge of second rectangular element 31 |
| 43 | edge of third rectangular element 32 |
| 44 | edge of fourth rectangular element 33 |
| 45 | opposing edge of second rectangular element 31 |
| 46 | opposing edge of second rectangular element 31 |
| 47 | opposing edge of third rectangular element 32 |
| 48 | opposing edge of third rectangular element 32 |
| 49 | opposing edge of fourth rectangular element 33 |
| 50 | opposing edge of fourth rectangular element 33 |
| 52 | glue line |
| 54 | glue line |
| $H_1$ | height of case 4 |
| $L_1$ | width of case 4 |
| $H_2$ | height of case 4 |
| $L_2$ | width of case 4 |

What is claimed is:

1. A blank for a case with display card, said blank having a first part being provided to form the case comprising a body defining at least one opening and closable flaps for closing said at least one opening, and a second part being provided to form the display card having an area greater than a straight forward projection of the case on said display card; the display card comprising at least one fixing strengthening flap extending beyond the periphery of the display card and covering one of the at least one opening, wherein said fixing strengthening flap is intended to be fixed with at least one of the closable flaps in such a way as to increase the link between the case and the display card when the case formed on the display card is closed wherein the fixing strengthening flap only partially covers the at least one opening when it is in the closed position.

2. A blank according to claim 1, wherein the display card comprises a first panel provided with a first zone with height at least equal to the height of the case and width at least equal to the width of the case, and a second zone, adjacent to the first zone, with height and width, the first panel being provided with a hooking aperture in its second zone; the first zone being arranged opposite the reai of the case once the case is closed.

3. A blank according to claim 2, wherein the display card also comprises at least one second panel, adjacent and hinged to the first panel, provided with a hooking aperture arranged so as to interact with the corresponding aperture of the first panel, and intended to be folded and fixed to the first panel.

4. A blank according to claim 1, wherein the first part and the second part are hinged to two opposite edges of a third part in such a way as to distance the case from the edges of the display card.

5. A blank according to claim 1, wherein the first part of the blank comprises:

a) a first element used for a first lateral side provided, on two opposite sides, with two flaps hinged on this first element, these flaps being intended to close the openings of the case;

b) a second element used for the front, hinged to one of the sides of the first element not used by the flaps hinged to the sides of the first element, being provided, on two opposite sides, with two flaps intended to close the openings of the case;

c) a third element, used for a second lateral side, practically identical to the first element hinged to one of the sides of the second element not used by the flaps hinged to the sides of the second element, provided, on two opposite sides, with two flaps intended to close the openings of the case; and d) a fourth element used for the rear practically identical to the second element and intended to be fixed to the display card to hold the two lateral sides and the front in position in relation to the fourth element.

6. A blank according to claim 5, wherein the fixing strengthening flap only partially covers the opening when it is in the closed position.

7. A case in cardboard with hooking tab obtained from a blank having a first part intended to form said case having a body defining at least one opening and provided with closing flaps intended to close this opening, and a second part intended to form a display card whose area is greater than the straight forward projection of the case on this card; the second part of said blank comprising at least one fixing strengthening flap extending beyond the periphery of the card and intended to be fixed to at least one of the closing flaps in such a way as to increase the link between the case and the display card when the case formed on the display card is closed wherein the facing strengthening flap only partially covers the at least one opening when it is in the closed position.

8. A case according to the claim 7, wherein the fixings are obtained by gluing.

* * * * *